US006025807A

United States Patent [19]

Jon et al.

[11] Patent Number: 6,025,807

[45] Date of Patent: Feb. 15, 2000

[54] ORIENTATION INDEPENDENT LOOP ANTENNA

[75] Inventors: Min-Chung Jon, Princeton; Vito Palazzo, Ewing, both of N.J.

[73] Assignee: Lucent Technologies, Inc., Murray Hill, N.J.

[21] Appl. No.: 09/267,290

[22] Filed: Mar. 12, 1999

[51] Int. Cl.[7] ..... H01Q 11/12

[52] U.S. Cl. ..... 343/742; 343/867

[58] Field of Search ..... 343/742, 741, 343/748, 855, 866, 867, 870

[56] References Cited

U.S. PATENT DOCUMENTS

| | | | |
|---|---|---|---|
| 2,537,191 | 1/1951 | Moore | 343/742 |
| 4,214,210 | 7/1980 | O'Shea | 455/282 |
| 4,631,473 | 12/1986 | Honda | 324/72.5 |
| 4,634,975 | 1/1987 | Eccleston et al. | 324/232 |
| 5,552,796 | 9/1996 | Diamond | 343/742 |
| 5,592,182 | 1/1997 | Yao et al. | 343/742 |
| 5,663,738 | 9/1997 | Mueller | 343/742 |

*Primary Examiner*—Don Wong
*Assistant Examiner*—Jennifer H. Malos

[57] ABSTRACT

This invention relates to an antenna for use in detecting electromagnetic noise radiation in which a high frequency, asymmetric signal has been generated. The invention relates to a loop antenna design which uses two loops that are run in opposite direction to each other, thereby resulting in two out-of-phase signals being detected in the loops which are then combined as the antenna output.

10 Claims, 4 Drawing Sheets

ORIENTATION INDEPENDENT LOOP ANTENNA

BACKGROUND OF THE INVENTION

1. Field of the Invention

This invention relates to an antenna for use in detecting electromagnetic noise radiation in which a high frequency, asymmetric signal was generated. More specifically, this invention relates to a loop antenna design which uses two loops that are run in opposite direction to each other, thereby resulting in two out-of-phase signals being detected in the loops which are then combined as the antenna output.

2. Description of Related Art

Electromagnetic noise radiation can result from a variety of sources, for example, electrical arcs or sparking gaps. Such signals can cause radio interference or noise. More importantly, such signals result from an electrostatic discharge (ESD) which are incapable of even being perceived by a human being but which can cause significant damage to sophisticated electronic equipment.

It is well known in the art that a loop antenna system is particularly useful in sensing radiate fields from electrical arcs. An example of such a system is disclosed in U.S. Pat. No. 4,214,210, issued to Martin O'Shea on Jul. 22, 1980 and entitled "Electromagnetic Noise Source Locator". One advantage of such a loop antenna system is its ability to sense a broad frequency spectrum. However, it is also well known that the sensitivity of a loop antenna is affected by its orientation to the signal source. Such a characteristic may be of use in locating the direction of the source of a continuous signal. However this sensitivity is a significant disadvantage in measuring or even recognizing a single electric arc occurring at a location whose direction is unknown.

An additional consideration in ESD event detectors is exemplified in U.S. Pat. No. 4,631,473 issued to Masamitsu Honda on Dec. 23, 1986 and entitled "Transient Electromagnetic Field Detector". This Honda patent relates to providing a momentary indication of the existence of an ESD event by comparing the amplitude of a received signal's waveform against a predetermined threshold, irrespective of how may ESD events the received signal waveform actually represents. That is, a single ESD event produces electromagnetic radiation which may be reflected by nearby metallic objects, resulting in the receipt of several signal peaks above a predetermined threshold. Thus, a significant limitation on the accuracy of existing ESD detectors is their ability to distinguish a multi-peak waveform representing a single ESD event from a waveform that represents several ESD events. Such accuracy is critical in determining the relative effectiveness of various proposed methods of ESD mitigation in environments where electronic devices prone to ESD damage, are assembled and used.

Applicants' copending U.S. patent application Ser. No. 08/842,920 filed Apr. 17, 1997 and titled "Electrostatic Discharge Event Detector" (and subsequently allowed Nov. 23, 1998), hereby incorporated by reference, relates to a device which is able to distinguish multi-peak waveforms resulting from a single ESD event. To make such a distinction, this device or alternative devices performing the same function must evaluate signals whose frequency readily exceeds 1 GHz ($10^9$ Hz). That is, any device, which receives as input the ESD wave signal detected by a conventional antenna, must be capable of processing this signal at this high frequency rate to be able to properly evaluate if a single ESD event has occurred.

SUMMARY OF THE INVENTION

This invention relates to an improved antenna for use in detecting electromagnetic noise radiation in which a high frequency, asymmetric signal is generated. The antenna design of the present invention uses two loops that run in opposite directions to each other. These two loops are separated by the thickness of the material used for insulating the conductive wires of the loops. This physical separation and a slight shift of the loops from being parallel, will prevent the out-of-phase signals in the loops from completely canceling each other. Rather, the out-of-phase signals in the two loops will in effect combine to thereby lower the overall frequency of the signals, thereby permitting more efficient processing in any apparatus which uses the new antenna invention. Further, this combining of these out-of-phase loop signals in this manner, makes the resulting output of the new antenna far less sensitive to the orientation of the antenna relative to the ESD source.

These and other features of the invention will be more fully understood by reference to the following drawings.

DETAILED DESCRIPTION OF THE INVENTION

During the course of this description, like numbers will be used to identify like elements according to different figures which illustrate the invention.

Figure 1:
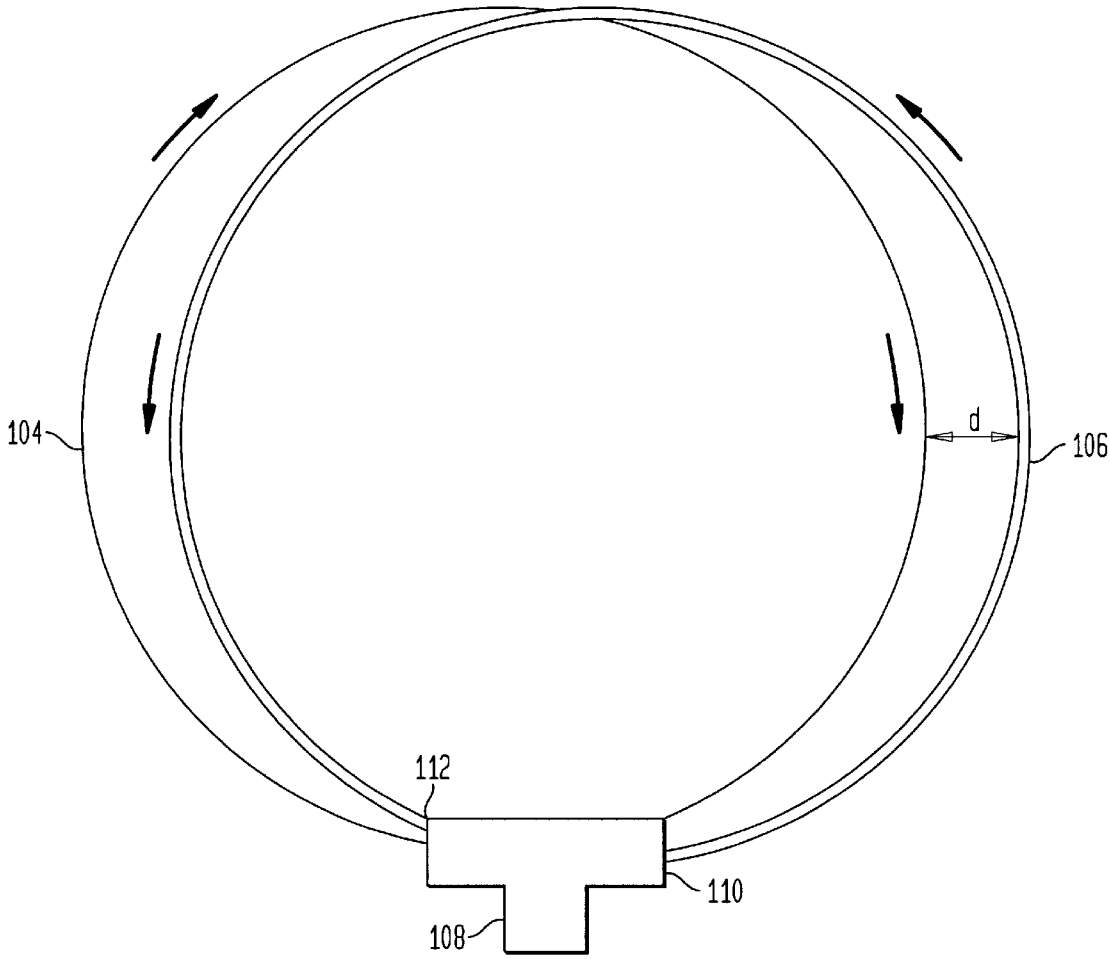
FIG. 1 is a perspective view of the two loop antenna of the present invention.

FIG. 1 shows the two loop antenna of the present invention which is a radiation device including a first conductive loop 104, a second conductive loop 106, and a conductive planar base element 108. In the preferred embodiment, this base element 108 is a well-known T-connector having a center connection 110 and a ground connection 112. As depicted in FIG. 1, loop 104 runs in a clockwise direction from its connection to the central connection 110 to the ground connection 112; while loop 106 runs in a counterclockwise direction from its connection to the central connection 110 to the ground connection 112.

In the preferred embodiment, each of these loops comprises an insulated conductive wire. Accordingly, at a minimum the conductive wires of the loops are separated by the thickness of the insulation materials. In the preferred embodiment these conductive wires are insulated aluminum wire, 0.064 cm. in diameter. As also depicted in FIG. 1, the loops are shifted from being parallel by a fixed separation which measures d at the point of maximum separation. In the preferred embodiment of the present invention, each loop is approximately a circle whose diameter is 9.40 cm (plus or minus a 10% tolerance) and the distance d is 0.5 cm plus or minus a 10% tolerance.

Figure 2:
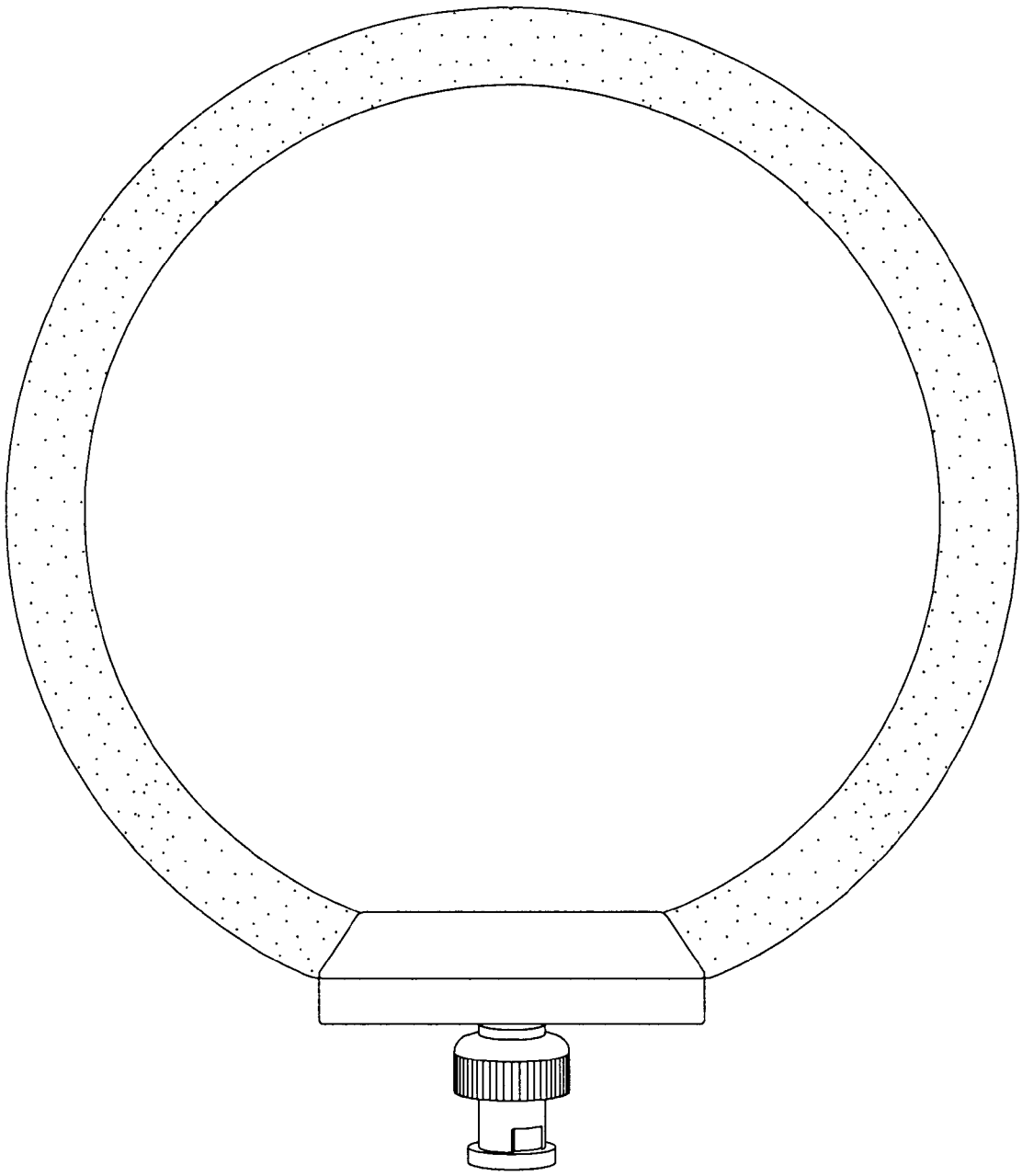
FIG. 2 is an illustration of the present invention with the two loops encased in a protective coating.

In the preferred embodiment of the invention, this double loop arrangement is encased in a protective, nonconductive coating 120 as depicted in FIG. 2. This coating adds rigidity to the structure thereby maintaining the proper shape and separation of the loops.

This configuration of the two loops in essentially parallel, opposite directions produces two out of phase signals. Such an antenna arrangement violates the general principal in which one seeks to avoid such weakening or canceling of all or part of the signal one is receiving. As noted above, the separation of the loops by both the insulation material and the shift angle prevents these out of phase signals from canceling each other completely. Moreover, the combining of the signal received by each loop results in an output signal of the present antenna invention which has two significant advantages in a system used to detect electromagnetic noise radiation.

Figure 3A:
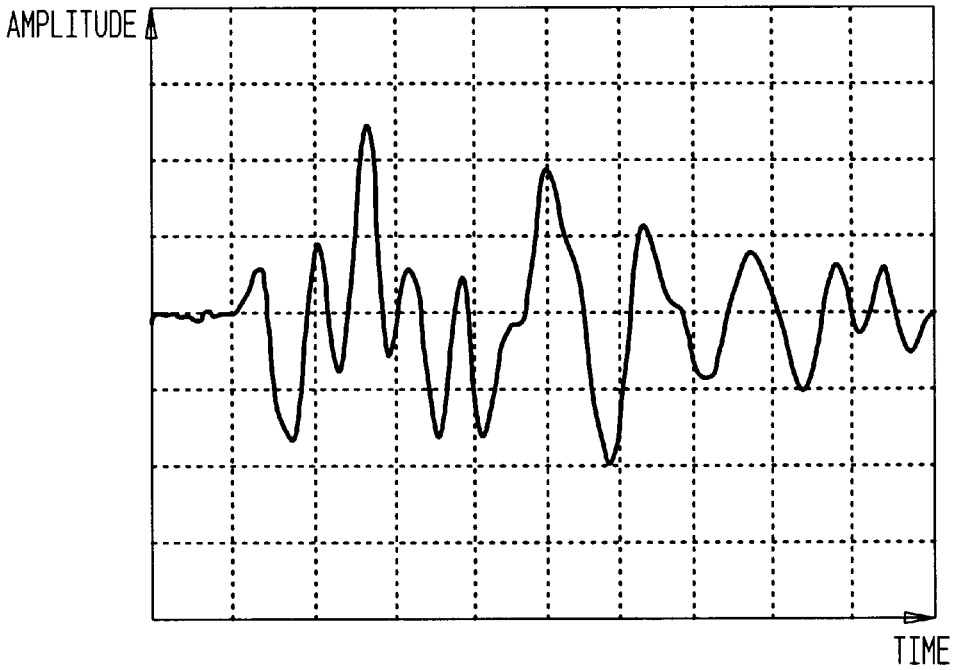
FIGS. 3A and 3B are graphical representations of the output of a conventional, single loop antenna depicting amplitude as a function of time for antenna orientations which differ by 90°.

FIG. 3A shows an illustrative voltage waveform which is detected at a single loop antenna when a single ESD discharge of 300 volts occurs at a distance of 5 feet from the antenna. In free space, the waveform of FIG. 3A would show only one amplitude peak, representing the electromagnetic pulse generated by the ESD event. The multiple peaks of the waveform of FIG. 3A result when the electromagnetic pulse is reflected by various objects in the vicinity of the ESD event, and the antenna then receives the direct pulse form the ESD event, along with one or more reflected pulses slightly offset in time from the direct pulse. To properly evaluate an ESD event, a ESD detector needs to characterize the waveform of FIG. 3A as representing a single ESD event.

Figure 3B:
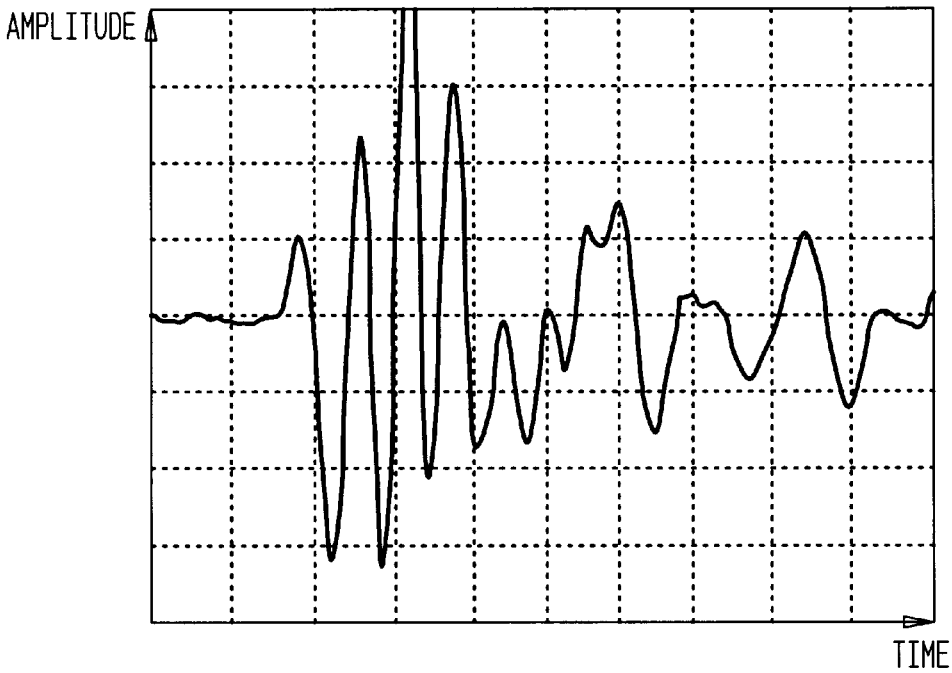

FIG. 3B illustrates the voltage waveform which is detected at a single loop antenna when the same single ESD discharge of 300 volts occurs at the same 5 foot distance. However, in FIG. 3B the loop antenna has been rotated 90° from the position it occupied while measuring the data depicted in FIG. 3A. Clearly any system which attempts to evaluate such data to accurately determine how many ESD events occurred would have difficulty in attaining the same result when processing as its input the data of FIG. 3A versus that of FIG. 3B—peaks occurring at different locations and with significant differences in amplitude (in fact, some peaks disappear).

Figure 4A:
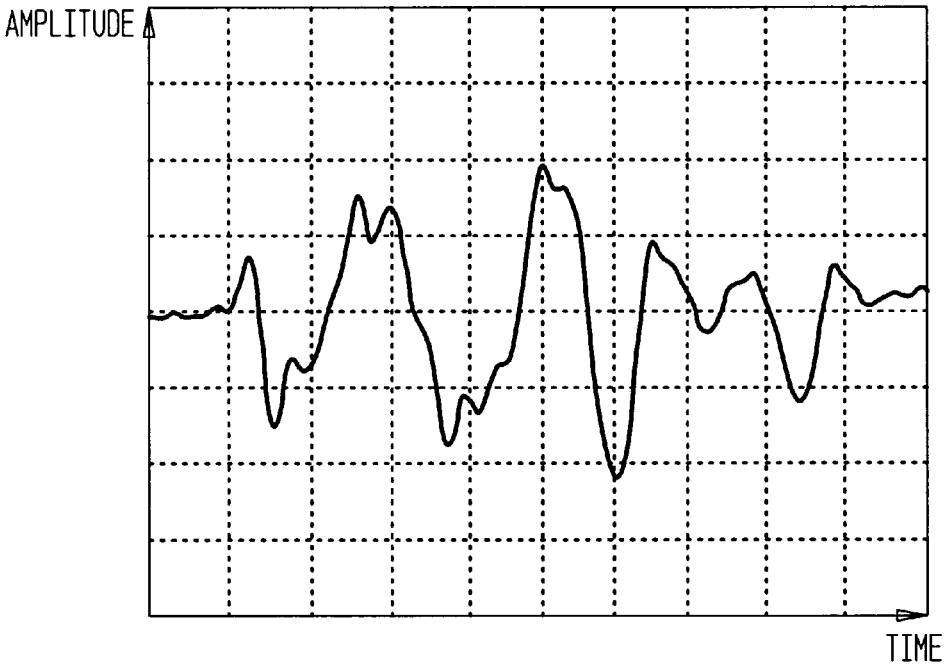
FIGS. 4A and 4B are graphical representations of the output of the two loop antenna of the present invention depicting amplitude as a function of time for antenna orientations which differ by 90°.
Figure 4B:
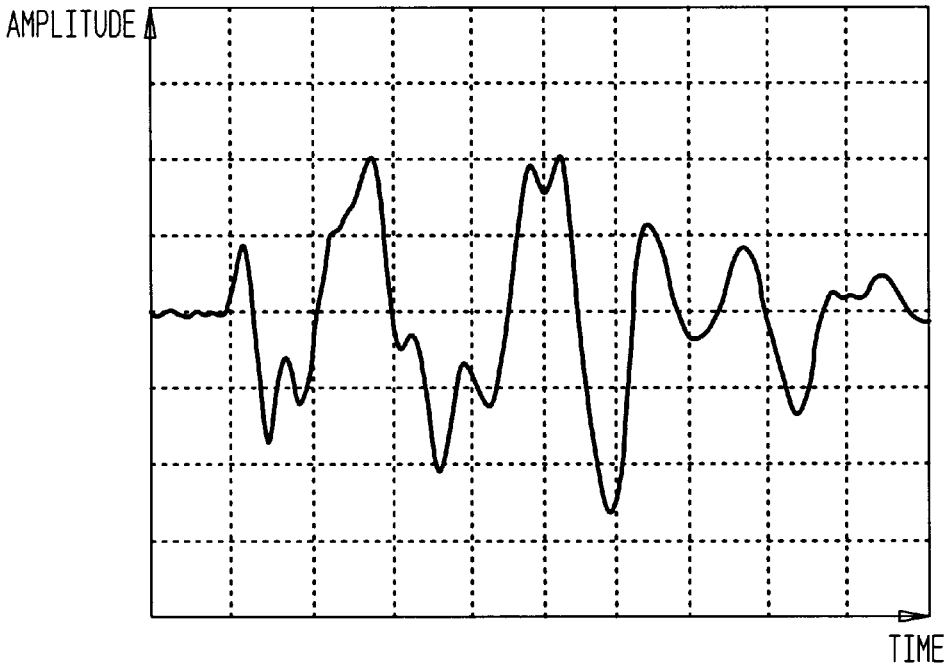

FIG. 4A again illustrates the voltage waveform which is detected when the same single ESD discharge of 300 volts occurs at the same 5 foot distance. However in FIG. 4A the detection is performed by the two-loop antenna of the present invention. When this two-loop antenna is rotated by 90°, the detected output, depicted in FIG. 4B, yields only minor changes in the resulting waveform. This same effect has been experimentally demonstrated for arbitrary angles between 0° and 360° as well. Thus, the first advantage of the present invention is that the new antenna system clearly lacks the inherent directional sensitivity of a conventional loop antenna.

The second advantage in using the antenna output of the present invention in detecting electromagnetic noise radiation is demonstrated by a comparison of FIGS. 3 and 4. These figures have the same scale both with respect to amplitude (the y-axis) and time (the x-axis). The depicted waveforms were detected by corresponding antennae having loops of the same diameter. FIG. 3 thus demonstrates that the frequency of the detected signal has been reduced by approximately ½ of the signal frequency detected in FIG. 4. Thus the antenna system of the present invention has essentially acted as a real-time, front-end analogue processor to reduce the frequency of the detected signal.

In the preferred embodiment the frequency of the detected ESD event is reduced from approximately 1 GHz to 500 MHz. Consequently, a system which then processes the antenna output of the present invention would then need only be engineered to process a signal at approximately ½ the frequency of the output of a conventional loop antenna of the same size. This readily transforms into improved efficiency and resulting cost savings in any such downstream application system.

While the invention has been described with reference to the preferred embodiment thereof, it will be appreciated by those of ordinary skill in the art that various modifications can be made to the structure and function of the individual parts of the system without departing from the sprit and scope of the invention as a whole.

We claim:

1. An antenna system for use in a electrical device which detects high frequency electromagnetic noise, said antenna comprising:

(a) a conductive base element comprising a center connection terminal and a ground connection terminal;

(b) a first conductive loop lying in a first loop plane and extending in a clockwise direction from the center connection terminal to the ground connection terminal; and, (c) a second conductive loop, having substantially the same shape and form as said first conductive loop, lying in a second loop plane and extending in a counterclockwise direction from the center connection terminal to the ground connection terminal, wherein said first loop plane and said second loop plane are substantially parallel and wherein the first conductive loop is displaced in the first loop plane a maximum fixed distance d from said second conductive loop.

2. The antenna system of claim 1 wherein the conductive base element is a T-connector.

3. The antenna system of claim 2 wherein each conductive loop comprises an approximate circle of fixed diameter x, where x is in the range of 9.40 cm. plus or minus 10%.

4. The antenna system of claim 3 wherein the fixed distance of separation, d, is in the range of 0.5 cm plus or minus 10%.

5. The antenna system of claim 4 where the first conductive loop and the second conductive loop are encased in a nonconductive coating.

6. An antenna system for use in an electrical device which detects high frequency electromagnetic noise, said antenna comprising:

(a) a conductive base element comprising a center connection terminal and a ground connection terminal;

(b) a substantially circular first conductive loop extending in a clockwise direction from the center connection terminal to the ground connection terminal; and (c) a substantially circular second conductive loop, having substantially the same shape and form as said first conductive loop, extending in a counterclockwise direction from the center connection terminal to the ground connection terminal, wherein said first conductive loop and said second conductive loop are substantially co-planar and wherein the center of the first conductive loop is displaced in the plane a fixed distance, d, from the center of the second conductive loop, said distance, d, being less than the maximum width of either loop.

7. The antenna system of claim 6 wherein the conductive base element is a T-connector.

8. The antenna system of claim 7 wherein each conductive loop has a fixed diameter x, where x is in the range of 9.40 cm. plus or minus 10%.

9. The antenna system of claim 8 wherein the fixed distance d is in the range of 0.5 cm plus or minus 10%.

10. The antenna system of claim 9 where the first conductive loop and the second conductive loop are encased in a nonconductive coating.

* * * * *